US006761534B1

(12) United States Patent
Willett

(10) Patent No.: US 6,761,534 B1
(45) Date of Patent: Jul. 13, 2004

(54) COOLING CIRCUIT FOR A GAS TURBINE BUCKET AND TIP SHROUD

(75) Inventor: Fred Thomas Willett, Burnt Hills, NY (US)

(73) Assignee: General Electric Company, Schenectady, NY (US)

( * ) Notice: Subject to any disclaimer, the term of this patent is extended or adjusted under 35 U.S.C. 154(b) by 68 days.

(21) Appl. No.: 09/286,151

(22) Filed: Apr. 5, 1999

(51) Int. Cl.[7] ..... F01D 5/18

(52) U.S. Cl. ..... 416/97 R; 416/90 R; 416/92; 416/191; 416/192

(58) Field of Search ..... 416/90 R, 92, 416/189–192, 96 R, 96 A, 97 R; 415/115

(56) References Cited

U.S. PATENT DOCUMENTS

| | | | | | |
|---|---|---|---|---|---|
| 1,651,503 | A | | 12/1927 | Belluzzo | |
| 3,014,270 | A | | 12/1961 | Eccles | |
| 3,427,001 | A | | 2/1969 | Malley et al. | |
| 3,527,544 | A | * | 9/1970 | Allen | 416/92 |
| 3,533,711 | A | | 10/1970 | Kercher | |
| 3,606,574 | A | | 9/1971 | Brands et al. | |
| 3,628,885 | A | | 12/1971 | Sidenstick et al. | |
| 3,876,330 | A | * | 4/1975 | Pearson et al. | 416/92 |
| 3,982,851 | A | * | 9/1976 | Andersen et al. | 416/92 |
| 4,012,167 | A | * | 3/1977 | Noble | 416/97 A |
| 4,073,599 | A | * | 2/1978 | Allen et al. | 416/97 R |
| 4,127,358 | A | | 11/1978 | Parkes | |
| 4,162,136 | A | * | 7/1979 | Parkes | 416/97 R |
| 4,606,701 | A | | 8/1986 | McClay et al. | |
| 4,940,388 | A | | 7/1990 | Lilleker et al. | |
| 4,948,338 | A | | 8/1990 | Wickerson | |
| 5,350,277 | A | | 9/1994 | Jacala et al. | |
| 5,391,052 | A | | 2/1995 | Correia et al. | |
| 5,460,486 | A | | 10/1995 | Evans et al. | |
| 5,480,281 | A | | 1/1996 | Correia | |
| 5,482,435 | A | | 1/1996 | Dorris et al. | |
| 5,486,090 | A | | 1/1996 | Thompson et al. | |
| 5,531,568 | A | | 7/1996 | Broadhead | |
| 5,538,393 | A | | 7/1996 | Thompson et al. | |
| 5,785,496 | A | | 7/1998 | Tomita | |
| 6,099,253 | A | | 8/2000 | Fukue et al. | |
| 6,152,695 | A | * | 11/2000 | Fukue et al. | 416/97 R |
| 6,340,284 | B1 | | 1/2002 | Beeck et al. | |
| 6,499,950 | B2 | * | 12/2002 | Willett et al. | 416/97 R |

FOREIGN PATENT DOCUMENTS

| | | | | |
|---|---|---|---|---|
| FR | 2 275 975 | | 2/1976 | |
| GB | 960071 | | 6/1964 | |
| GB | 1426049 | * | 2/1976 | 416/97 R |
| GB | 2067674 | * | 7/1981 | 416/92 |
| JP | 58-47104 A | | 3/1983 | |
| JP | 2-23201 | * | 1/1990 | 416/96 A |
| JP | 2-221602 A | | 9/1990 | |

OTHER PUBLICATIONS

"39$^{th}$ GE Turbine State–of–the–Art Technology Seminar", Tab 1,""F" Technology—the First Half–Million Operating Hours", H.E. Miller, Aug. 1996.

(List continued on next page.)

*Primary Examiner*—Christopher Verdier
(74) *Attorney, Agent, or Firm*—Nixon & Vanderhye P.C.

(57) ABSTRACT

An open cooling circuit for a gas turbine airfoil and associated tip shroud includes a first group of cooling holes internal to the airfoil and extending in a radially outward direction generally along a leading edge of the airfoil; a second group of cooling holes internal to the airfoil and extending in a radially outward direction generally along a trailing edge of the airfoil. A common plenum is formed in the tip shroud in direct communication with the first and second group of cooling holes, but a second plenum may be provided for the second group of radial holes. A plurality of exhaust holes extends from the plenum(s), through the tip shroud and opening along a peripheral edge of the tip shroud.

9 Claims, 4 Drawing Sheets

OTHER PUBLICATIONS

"39th GE Turbine State–of–the–Art Technology Seminar", Tab 2, "GE Heavy–Duty Gas Turbine Performance Characteristics", F. J. Brooks, Aug. 1996.
"39th GE Turbine State–of–the–Art Technology Seminar", Tab 3, "9EC 50Hz 170–MW Class Gas Turbine", A. S. Arrao, Aug. 1996.
"39th GE Turbine State–of–the–Art Technology Seminar", Tab 4, "MWS6001FA—An Advanced–Technology 70–MW Class 50/60 Hz Gas Turbine", Ramachandran et al., Aug. 1996.
"39th GE Turbine State–of–the–Art Technology Seminar", Tab 5, "Turbomachinery Technology Advances at Nuovo Pignone", Benvenuti et al., Aug. 1996.
"39th GE Turbine State–of–the–Art Technology Seminar", Tab 6, "GE Aeroderivative Gas Turbines—Design and Operating Features", M.W. Horner, Aug. 1996.
"39th GE Turbine State–of–the–Art Technology Seminar", Tab 7, "Advance Gas Turbine Materials and Coatings", P.W. Schilke, Aug. 1996.
"39th GE Turbine State–of–the–Art Technology Seminar", Tab 8, "Dry Low $NO_x$ Combustion System for GE Heavy–Duty Turbines", L. B. Davis, Aug. 1996.
"39th GE Turbine State–of–the–Art Technology Seminar", Tab 9, "GE Gas Turbine Combustion Flexibility", M. A. Davi, Aug. 1996.
"39th GE Turbine State–of–the–Art Technology Seminar", Tab 10, "Gas Fuel Clean–Up System Design Considerations for GE Heavy–Duty Gas Turbines", C. Wilkes, Aug. 1996.
"39th GE Turbine State–of–the–Art Technology Seminar", Tab 11, "Integrated Control Systems for Advanced Combined Cycles", Chu et al., Aug. 1996.
"39th GE Turbine State–of–the–Art Technology Seminar", Tab 12, "Power Systems for the 21st Century "H" Gas Turbine Combined Cycles", Paul et al., Aug. 1996.
"39th GE Turbine State–of–the–Art Technology Seminar", Tab 13, "Clean Coal and Heavy Oil Technologies for Gas Turbines", D. M. Todd, Aug. 1996.
"39th GE Turbine State–of–the–Art Technology Seminar", Tab 14, "Gas Turbine Conversions, Modifications and Uprates Technology", Stuck et al., Aug. 1996.
"39th GE Turbine State–of–the–Art Technology Seminar", Tab 15, "Performance and Reliability Improvements for Heavy–Duty Gas Turbines,"J. R. Johnston, Aug. 1996.
"39th GE Turbine State–of–the–Art Technology Seminar", Tab 16, "Gas Turbine Repair Technology", Crimi et al, Aug. 1996.
"39th GE Turbine State–of–the–Art Technology Seminar", Tab 17, "Heavy Duty Turbine Operating & Maintenance Considerations", R. F. Hoeft, Aug. 1996.
"39th GE Turbine State–of–the–Art Technology Seminar", Tab 18, "Gas Turbine Performance Monitoring and Testing", Schmitt et al., Aug. 1996.
"39th GE Turbine State–of–the–Art Technology Seminar", Tab 19, "Monitoring Service Delivery System and Diagnostics", Madej et al, Aug. 1996.
"39th GE Turbine State–of–the–Art Technology Seminar", Tab 20, "Steam Turbines for Large Power Applications", Reinker et al., Aug. 1996.
"39th GE Turbine State–of–the–Art Technology Seminar", Tab 21, "Steam Turbines for Ultrasupercritical Power Plants", Retzlaff et al., Aug. 1996.
"39th GE Turbine State–of–the–Art Technology Seminar", Tab 22, "Steam Turbine Sustained Efficiency", P. Schofield, Aug. 1996.
"39th GE Turbine State–of–the–Art Technology Seminar", Tab 23, "Recent Advances in Steam Turbines for Industrial and Cogeneration Applications", Leger et al., Aug. 1996.
"39th GE Turbine State–of–the–Art Technology Seminar", Tab 24, "Mechanical Drive Steam Turbines", D. R. Leger, Aug. 1996.
"39th GE Turbine State–of–the–Art Technology Seminar", Tab 25, "Steam Turbines for STAG™ Combined–Cycle Power Systems", M. Boss, Aug. 1996.
"39th GE Turbine State–of–the–Art Technology Seminar", Tab 26, "Cogeneration Application Considerations", Fisk et al., Aug. 1996.
"39th GE Turbine State–of–the–Art Technology Seminar", Tab 27, "Performance and Economic Considerations of Repowering Steam Power Plants", Stoll et al., Aug. 1996.
"39th GE Turbine State–of–the–Art Technology Seminar", Tab 28, "High–Power–Density™ Steam Turbine Design Evolution", J. H. Moore, Aug. 1996.
"39th GE Turbine State–of–the–Art Technology Seminar", Tab 29, "Advances in Steam Path Technologies", Cofer, IV, et al., Aug. 1996.
"39th GE Turbine State–of–the–Art Technology Seminar", Tab 30, "Upgradable Opportunities for Steam Turbines", D. R. Dreier, Jr., Aug. 1996.
"39th GE Turbine State–of–the–Art Technology Seminar", Tab 31, "Uprate Options for Industrial Turbines", R. C. Beck, Aug. 1996.
"39th GE Turbine State–of–the–Art Technology Seminar", Tab 32, "Thermal Performance Evaluation and Assessment of Steam Turbine Units", P. Albert, Aug. 1996.
"39th GE Turbine State–of–the–Art Technology Seminar", Tab 33, "Advances in Welding Repair Technololgy"J. F. Nolan, Aug. 1996.
"39th GE Turbine State–of–the–Art Technology Seminar", Tab 34, "Operation and Maintenance Strategies to Enhance Plant Profitability", MacGillivray et al., Aug. 1996.
"39th GE Turbine State–of–the–Art Technology Seminar", Tab 35, "Generator Insitu Inspections", D. Stanton
"39th GE Turbine State–of–the–Art Technology Seminar", Tab 36, "Generator Upgrade and Rewind", Halpern et al., Aug. 1996.
"39th GE Turbine State–of–the–Art Technology Seminar", Tab 37, "GE Combined Cycle Product Line and Performance", Chase, et al., Aug. 1996.
"39th GE Turbine State–of–the–Art Technology Seminar", Tab 38, "GE Combined Cycle Experience", Maslak et al., Aug. 1996.
"39th GE Turbine State–of–the–Art Technology Seminar", Tab 39, "Single–Shaft Combined Cycle Power Generation Systems", Tomlinson et al., Aug. 1996.
"Advanced Turbine System Program—Conceptual Design and Product Development", Annual Report, Sep. 1, 1994—Aug. 31, 1995.
"Advanced Turbine Systems (ATS Program) Conceptual Design and Product Development", Final Technical Progress Report, Vol. 2– Industrial Machine, Mar. 31, 1997, Morgantown, WV.
"Advanced Turbine Systems (ATS Program), Conceptual Design and Product Development", Final Technical Progress Report, Aug. 31, 1996, Morgantown, WV.

"Advanced Turbine Systems (ATS) Program, Phase 2, Conceptual Design and Product Development", Yearly Technical Progress Report, Reporting Period: Aug. 25, 1993—Aug. 31, 1994.
"Advanced Turbine Systems" Annual Program Review, Preprints, Nov. 2–4, 1998, Washington, D.C. U.S. Department of Energy, Office of Industrial Technologies Federal Energy Technology Center.
"ATS Conference" Oct. 28, 1999, Slide Presentation.
"Baglan Bay Launch Site", various articles relating to Baglan Energy Park.
"Baglan Energy Park", Brochure.
"Commercialization", Del Williamson, Present, Global Sales, May 8, 1998.
"Environmental, Health and Safety Assessment: ATS 7H Program (Phase 3R) Test Activities at the GE Power Systems Gas Turbine Manufacturing Facility, Greenville, SC", Document#1753, Feb. 1998, Publication Date: Nove. 17, 1998, Report Nos. DE–FC21–95MC31176—11.
"Exhibit panels used at 1995 product introduction at PowerGen Europe".
"Extensive Testing Program Validates High Efficiency, reliability of GE's Advanced "H" Gas Turbine Technology", Press Information, Press Release, 96–NR14, Jun. 26, 1996, H Technology Tests/pp. 1–4.
"Extensive Testing Program Validates High Efficiency, Reliability of GE's Advanced "H" Gas Turbine Technology", GE Introduces Advanced Gas Turbine Technology Platform: First to Reach 60% Combined–Cycle Power Plant Efficiency, Press Information, Press Release, Power–Gen Europe '95, 95–NRR15, Advanced Technology Introduction/pp. 1–6.
"Gas, Steam Turbine Work as Single Unit in GE's Advanced H Technology Combined–Cycle System", Press Information, Press Release, 95–NR18, May 16, 1995, Advanced Technology Introduction/pp. 1–3.
"GE Breaks 60% Net Efficiency Barrier" paper, 4 pages.
"GE Businesses Share Technologies and Experts to Develop State–Of–The–Art Products", Press Information, Press Release 95–NR10, May 16, 1995, GE Technology Transfer/pp. 1–3.
"General Electric ATS Program Technical Review, Phase 2 Activities", T. Chance et al., pp. 1–4.
"General Electric's DOE/ATS H Gas Turbine Development" Advanced Turbine Systems Annual Review Meeting, Nov. 7–8, 1996, Washington, D.C., Publication Release.
"H Technology Commercialization", 1998 MarComm Activity Recommendation, Mar., 1998.
"H Technology", Jon Ebacher, VP, Power Gen Technology, May 8, 1998.
"Heavy–Duty & Aeroderivative Products" Gas Turbines, Brochure, 1998.
"MS7001H/MS9001H Gas Turbine, gepower.com website for PowerGen Europe" Jun. 1–3 going public Jun. 15, (1995).
"New Steam Cooling System is a Key to 60% Efficiency for GE "H" Technology Combined–Cycle Systems", Press Information, Press Release, 95–NRR16, May 16, 1995, H Technology/pp. 1–3.
"Overview of GE's H Gas Turbine Combined Cycle", Jul. 1, 1995 to Dec. 31, 1997.
"Power Systems for the 21st Century—"H" Gas Turbine Combined Cycles", Thomas C. Paul et al., Report.
"Power–Gen '96 Europe", Conference Programme, Budapest, Hungary, Jun. 26–28, 1996.
"Power–Gen International", 1998 Show Guide, Dec. 9–11, 1998, Orange County Convention Center, Orlando, Florida.
"Press Coverage following 1995 product announcement"; various newspaper clippings relating to improved generator.
"Proceedings of the Advanced Turbine Systems Annual Program Review Meeting", vol. I, "Industrial Advanced Turbine Systems Program Overview", D.W. Esbeck, p. 3–13, Oct., 1995.
"Proceedings of the Advanced Turbine Systems Annual Program Review Meeting", vol. I, "H Gas Turbine Combined Cycle", J. Corman, p. 14–21, Oct., 1995.
"Proceedings of the Advanced Turbine Systems Annual Program Review Meeting", vol. I, "Overview of Westinghouse's Advanced Turbine Systems Program", Bannister et al., p. 22–30, Oct., 1995.
"Proceedings of the Advanced Turbine Systems Annual Program Review Meeting", vol. I, "Allison Engine ATS Program Technical Review", D. Mukavetz, p. 31–42, Oct., 1995.
"Proceedings of the Advanced Turbine Systems Annual Program Review Meeting", vol. I, "Advanced Turbine Systems Program Industrial System Concept Development", S. Gates, p. 43–63, Oct., 1995.
"Proceedings of the Advanced Turbine Systems Annual Program Review Meeting", vol. I, "Advanced Turbine System Program Phase 2 Cycle Selection", Latcovich, Jr., p. 64–69, Oct., 1995.
"Proceedings of the Advanced Turbine Systems Annual Program Review Meeting", vol. I, "General Electric ATS Program Technical Review Phase 2 Activities", Chance et al., p. 70–74, Oct., 1995.
"Proceedings of the Advanced Turbine Systems Annual Program Review Meeting", vol. I, "Technical Review of Westinghouse's Advanced Turbine Systems Program", Diakunchak et al., p. 75–86, Oct., 1995.
"Proceedings of the Advanced Turbine Systems Annual Program Review Meeting", vol. I, "Advanced Combustion Turbines and Cycles: An EPRI Perspective", Touchton et al., p. 87–88, Oct., 1995.
"Proceedings of the Advanced Turbine Systems Annual Program Review Meeting", vol. I, "Advanced Turbine Systems Annual Program Review", William E. Koop, p. 89–92, Oct., 1995.
"Proceedings of the Advanced Turbine Systems Annual Program Review Meeting", vol. I, "The AGTSR Consortium: An Update", Fant et al., p. 93–102, Oct., 1995.
"Proceedings of the Advanced Turbine Systems Annual Program Review Meeting", vol. I, "Overview of Allison/AGTSR Interactions", Sy A. Ali, p. 103–106, Oct., 1995.
"Proceedings of the Advanced Turbine Systems Annual Program Review Meeting", vol. I, "Design Factors for Stable Lean Premix Combustion", Richards et al., p. 107–113, Oct., 1995.
"Proceedings of the Advanced Turbine Systems Annual Program Review Meeting", vol. I, "Ceramic Stationary as Turbine", M. van Roode, p. 114–147, Oct., 1995.
"Proceedings of the Advanced Turbine Systems Annual Program Review Meeting", vol. I, "DOE/Allison Ceramic Vane Effort", Wenglarz et al., p. 148–151, Oct., 1995.

"Proceedings of the Advanced Turbine Systems Annual Program Review Meeting", vol. I, "Materials/Manufacturing Element of the Advanced Turbine Systems Program", Karnitz et al., p. 152–160, Oct., 1995.
"Proceedings of the Advanced Turbine Systems Annual Program Review Meeting", vol. I, "Land–Based Turbine Casting Initiative", Mueller et al., p. 161–170, Oct., 1995.
"Proceedings of the Advanced Turbine Systems Annual Program Review Meeting", vol. I, "Turbine Airfoil Manufacturing Technology", Kortovich, p. 171–181, Oct., 1995.
"Proceedings of the Advanced Turbine Systems Annual Program Review Meeting", vol. I, "Pratt & Whitney Thermal Barrier Coatings", Bornstein et al., p. 182–193, Oct., 1995.
"Proceedings of the Advanced Turbine Systems Annual Program Review Meeting", vol. I, "Westinhouse Thermal Barrier Coatings", Goedjen et al., p. 194–199, Oct., 1995.
"Proceedings of the Advanced Turbine Systems Annual Program Review Meeting", vol. I, "High Performance Steam Development", Duffy et al., p. 200–220, Oct., 1995.
"Proceedings of the Advanced Turbine Systems Annual Program Review Meeting", vol. II, "Lean Premixed Combustion Stabilized by Radiation Feedback and heterogeneous Catalysis", Dibble et al., p. 221–232, Oct., 1995.
"Proceedings of the Advanced Turbine Systems Annual Program Review Meeting", vol. II, Rayleigh/Raman/LIF Measurements in a Turbulent Lean Premixed Combustor, Nandula et al. p. 233–248, Oct., 1995.
"Proceedings of the Advanced Turbine Systems Annual Program Review Meeting", vol. II, "Lean Premixed Flames for Low $No_x$ Combustors", Sojka et al., p. 249–275, Oct., 1995.
"Proceedings of the Advanced Turbine Systems Annual Program Review Meeting", vol. II, "Functionally Gradient Materials for Thermal Barrier Coatings in Advanced Gas Turbine Systems", Banovic et al., p. 276–280, Oct., 1995.
"Proceedings of the Advanced Turbine Systems Annual Program Review Meeting", vol. II, "Advanced Turbine Cooling, Heat Transfer, and Aerodynamic Studies", Han et al., p. 281–309, Oct., 1995.
"Proceedings of the Advanced Turbine Systems Annual Program Review Meeting", vol. II, "Life Prediction of Advanced Materials for Gas Turbine Application", Zamrik et al., p. 310–327, Oct., 1995.
"Proceedings of the Advanced Turbine Systems Annual Program Review Meeting", vol. II, "Advanced Combustion Technologies for Gas Turbine Power Plants", Vandsburer et al., p. 328–352, Oct., 1995.
"Proceedings of the Advanced Turbine Systems Annual Program Review Meeting", vol. II, "Combustion Modeling in Advanced Gas Turbine Sustems", Smoot et al., p. 353–370, Oct., 1995.
"Proceedings of the Advanced Turbine Systmes Annual Program Review Meeting", vol. II, "Heat Transfer in a Two–Pass Internally Ribbed Turbine Blade Coolant Channel with Cylindrical Vortex Generators", Hibbs et al. p. 371–390, Oct., 1995.
"Proceedings of the Advanced Turbine Systems Annual Program Review Meeting", vol. II, "Rotational Effects on Turbine Blade Cooling", Govatzidakia et al., p. 391–392, Oct., 1995.
"Proceedings of the Advanced Turbine Systems Annual Program Review Meeting", vol. II, "Manifold Methods for Methane Combustion", Yang et al., p. 393–409, Oct., 1995.
"Proceedings of the Advanced Turbine Systems Annual Program Review Meeting", vol. II, "Advanced Multistage Turbine Blade Aerodynamics, Performance, Cooling and Heat Transfer", Fleeter et al., p. 410–414, Oct., 1995.
"Proceedings of the Advanced Turbine Systems Annual Program Review Meeting, vol. II", The Role of Reactant Unmixedness, Strain Rate, and Length Scale on Premixed Combustor Performance, Samuelsen et al., p. 415–422, Oct., 1995.
"Proceedings of the Advanced Turbine Systems Annual Program Review Meeting", vol. II, "Experimental and Computational Studies of Film Cooling With Compound Angle Injection", Goldstein et al., p. 423–451, Oct., 1995.
"Proceedings of the Advanced Turbine Systems Annual Program Review Meeting", vol. II, "Compatibility of Gas Turbine Materials with Steam Cooling", Desai et al., p. 452–464, Oct., 1995.
"Proceedings of the Advanced Turbine Systems Annual Program Review Meeting", vol. II, "Use of a Laser–Induced Fluorescence Theraml Imaging System for Film Cooling Heat Transfer Measurement", M. K. Chyu, p. 465–473, Oct., 1995.
"Proceedings of the Advanced Turbine Systems Annual Program Review Meeting", vol. II, Effects of Geometry on Slot–Jet Film Cooling Performance, Hyams et al., p. 474–496 Oct., 1995.
"Proceedings of the Advanced Turbine Systems Annual Program Review Meeting", vol. II, "Steam as Turbine Blade Coolant: Experimental Data Generation", Wilmsen et al., p. 497–505, Oct., 1995.
"Proceedings of the Advanced Turbine Systems Annual Program Review Meeting", vol. II, "Combustion Chemical Vapor Deposited Coatings for Thermal Barrier Coating Systems", Hampikian et al., p. 506–515, Oct., 1995.
"Proceedings of the Advanced Turbine Systems Annual Program Review Meeting", vol. II, "Premixed Burner Experiments: Geometry, Mixing, and Flame Structure Issues", Gupta et al., p. 516–528, Oct., 1995.
"Proceedings of the Advanced Turbine Systems Annual Program Review Meeting", vol. II, "Intercooler Flow Path for Gas Turbines: CFD Design and Experiments", Agrawal et al., p. 529–538, Oct., 1995.
"Proceedings of the Advanced Turbine Systems Annual Program Review Meeting", vol. II, "Bond Strength and Stress Measurements in Thermal Barrier Coatings", Gell et al., p. 539–549, Oct., 1995.
"Proceedings of the Advanced Turbine Systems Annual Program Review Meeting", vol. II, "Active Control of Combustion Instabilities in Low $NO_x$ Gas Turbines", Zinn et al., p. 550–551, Oct., 1995.
"Proceedings of the Advanced Turbine Systems Annual Program Review Meeting", Vol. II, "Combustion Instability Modeling and Analysis", Santoro et al., p. 552–559, Oct., 1995.
"Proceedings of the Advanced Turbine Systems Annual Program Review Meeting", vol. II, "Flow and Heat Transfer in Gas Turbine Disk Cavities Subject to Nonuniform External Pressure Field", Roy et al., p. 560–565, Oct., 1995.
"Proceedings of the Advanced Turbine Systems Annual Program Review Meeting", vol. II, "Heat Pipe Turbine Vane Cooling", Langston et al., p. 566–572, Oct., 1995.

"Proceedings of the Advanced Turbine Systems Annual Program Review Meeting", vol. II, "Improved Modeling Techniques for Turbomachinery Flow Fields", Lakshminarayana et al., p. 573–581, Oct., 1995.
"Proceeings of the Advanced Turbine Systems Annual Program Review Meeting", vol. II, "Advanced 3D Inverse Method for Designing Turbomachine Blades", T. Dang, p. 582, Oct., 1995.
"Proceedings of the Advanced Turbine Systems Annual Program Review Meeting", "ATS and the Industries of the Future", Denise Swink, p. 1, Nov., 1996.
"Proceedings of the Advanced Turbine Systems Annual Program Review Meeting", "Gas Turbine Association Agenda", William H. Day, p. 3–16, Nov., 1996.
"Proceedings of the Advanced Turbine Systems Annual Program Review Meeting", "Power Needs in the Chemical Industry", Keith Davidson, p. 17–26, Nov., 1996.
"Proceedings of the Advanced Turbine Systems Annual Program Review Meeting", "Advanced Turbine Systems Program Overview", David Esbeck, p. 27–34, Nov., 1996.
"Proceedings of the Advanced Turbine Systems Annual Program Review Meeting", "Westinghouse's Advanced Turbine Systems Program", Gerard McQuiggan, p. 35–48, Nov., 1996.
"Proceedings of the Advanced Turbine Systems Annual Program Review Meeting", "Overview of GE's H Gas Turbine Combined Cycle", Cook et al., p. 49–72, Nov., 1996.
"Proceedings of the Advanced Turbine Systems Annual Program Review Meeting", "Allison Advanced Simple Cycle Gas Turbine System", William D. Weisbrod, p. 73–94, Nov., 1996.
"Proceedings of the Advanced Turbine Systems Annual Program Review Meeting", "The AGTSR Industry–University Consortium", Lawrence P. Golan, p. 95–110, Nov., 1996.
"Proceedings of the Advanced Turbine Systems Annual Program Review Meeting", "$NO_x$ and CO Emissions Models for Gas–Fired Lean–Premixed Combustion Turbines", A. Mellor, p. 111–122, Nov., 1996.
"Proceedings of the Advanced Turbine Systems Annual Program Review Meeting", "Methodologies for Active Mixing and Combustion Control", Uri Vandsburger, p. 123–156, Nov., 1996.
"Proceedings of the Advanced Turbine Systems Annual Program Review Meeting", "Combustion Modeling in Advanced Gas Turbine Systems", Paul O. Hedman, p. 157–180, Nov., 19967.
"Proceedings of the Advanced Turbine Systems Annual Program Review Meeting", "Manifold Methods for Methane Combustion", Stephen B. Pope, p. 181–188, Nov., 1996.
"Proceedings of the Advanced Turbine Systems Annual Program Review Meeting", "The Role of Reactant Unmixedness, Strain Rate, and Length Scale on Premixed Combustor Performance", Scott Samuelsen, p. 189–210, Nov., 1996.
"Proceedings of the Advanced Turbine Systems Annual Program Review Meeting", "Effect of Swirl and Momentum Distribution on Temperature Distribution in Premixed Flames", Ashwani K. Gupta, p. 211–232, Nov., 1996.
"Proceedings of the Advanced Turbine Systems Annual Program Review Meeting", "Combustion Instability Studies Application to Land–Based Gas Turbine Combustors", Robert J. Santoro, p. 232–252.
"Proceedings of the Advanced Turbine Systems Annual Program Review Meeting", Active Control of Combustion Instabilities in Low $NO_x$ Turbines, Ben T. Zinn, p. 253–264, Nov., 1996.
"Proceedings of the Advanced Turbine Systems Annual Program Review Meeting", "Life Prediction of Advanced Materials for Gas Turbine Application," Sam. Y. Zamrik, p. 265–274, Nov., 1996.
"Proceedings of the Advanced Turbine Systems Annual Program Review Meeting", "Combustion Chemical Vapor Deposited Coatings for Thermal Barrier Coating Systems", W. Brent Carter, p. 275–290, Nov., 1996.
"Proceedings of the Advanced Turbine Systems Annual Program Review Meeting", "Compatibility of Gas Turbine Materials with Steam Cooling", Vimal Desai, p. 291–314, Nov., 1996.
"Proceedings of the Advanced Turbine Systems Annual Program Review Meeting", "Bond Strength and Stress Measurements in Thermal Barrier Coatings", Maurice Gell, p. 315–334, Nov., 1996.
"Proceedings of the Advanced Turbine Systems Annual Program Review Meeting", "Advanced Multistage Turbine Blade Aerodynamics, Performance, Cooling and Heat Transfer", Sanford Fleeter, p. 335–356, Nov., 1996.
"Proceedings of the Advanced Turbine Systems Annual Program Review Meeting", "Flow Characteristics of an Intercooler System for Power Generating Gas Turbines", Ajay K. Agrawal, p. 357–370, Nov., 1996.
"Prodeedings of the Advanced Turbine Systems Annual Program Review Meeting","Improved Modeling Techniques for Turbomachinery Flow Fields", B. Lakshiminarayana, p. 371–392, Nov., 1996.
"Proceedings of the Advanced Turbine Systems Annual Program Review Meeting", "Development of an Advanced 3d & Viscous Aerodynamic Design Method for Turbomachine Components in Utility and Industrial Gas Turbine Applications", Thong Q. Dang, p. 393–406, Nov., 1996.
"Proceedings of the Advanced Turbine Systems Annual Program Review Meeting", "Advanced Turbine Cooling, Heat Transfer, and Aerodynamic Studies", Je–Chin Han, p. 407–426, Nov., 1996.
"Proceedings of the Advanced Turbine Systems Annual Program Review Meeting", "Heat Transfer in a Two–Pass Internally Ribbed Turbine Blade Coolant Channel with Vortex Generators", S. Acharya, p. 427–446.
"Proceedings of the Advanced Turbine Systems Annual Program Review Meeting", "Experimental and Computational Studies of Film Cooling with Compound Angle Injection", R. Goldstein, p. 447–460, Nov., 1996.
"Proceedings of the Advanced Turbine Systems Annual Program Review Meeting", "Study of Endwall Film Cooling with a Gap Leakage Using a Thermographic Phosphor Fluorescence Imaging System", Mingking K. Chyu, p. 461–470, Nov., 1996.
"Proceedings of the Advanced Turbine Systems Annual Program Review Meeting", "Steam as a Turbine Blade Coolant: External Side Heat Transfer", Abraham Engeda, p. 471–482, Nov., 1996.
"Proceedings of the Advanced Turbine Systems Annual Program Review Meeting", "Flow and Heat Transfer in Gas Turbine Disk Cavities Subject to Nonuniform External Pressure Field", Ramendra Roy, p. 483–498, Nov., 1996.

"Proceedings of the Advanced Turbine Systems Annual Program Review Meeting", "Closed–Loop Mist/Steam Cooling for Advanced Turbine Systems", Ting Wang, p. 499–512, Nov., 1996.
"Proceedings of the Advanced Turbine Systems Annual Program Review Meeting", "Heat Pipe Turbine Vane Cooling", Langston et al., p. 513–534, Nov., 1996.
"Proceedings of the Advanced Turbine Systems Annual Program Review Meeting", "EPRI's Combustion Turbine Program: Status and Future Directions", Arthur Cohn, p. 535,–552 Nov., 1996.
"Proceedings of the Advanced Turbine Systems Annual Program Review Meeting", "ATS Materials Support", Michael Karnitz, p. 553–576, Nov., 1996.
"Proceedings of the Advanced Turbine Systems Annual Program Review Meeting", "Land Based Turbine Casting Initiative", Boyd A. Mueller, p. 577–592, Nov., 1996.
"Proceedings of the Advanced Turbine Systems Annual Program Review Meeting", "Turbine Airfoil Manufacturing Technology", Charles S. Kortovich, p. 593–622, Nov., 1996.
"Proceedings of the Advanced Turbine Systems Annual Program Review Meeting", "Hot Corrosion Testing of TBS's", Norman Bornstein, p. 623–631, Nov., 1996.
"Proceedings of the Advanced Turbine Systems Annual Program Review Meeting", "Ceramic Stationary Gas Turbine", Mark van Roode, p. 633–658, Nov., 1996.
"Proceedings of the Advanced Turbine Systems Annual Program Review Meeting", "Western European Status of Ceramics for Gas Turbines", Tibor Bornemisza, p. 659–670, Nov., 1996.
"Proceedings of the Advanced Turbine Systems Annual Program Review Meeting", "Status of Ceramic Gas Turbines in Russia", Mark van Roode, p. 671, Nov., 1996.
"Status Report: The U.S. Department of Energy's Advanced Turbine systems Program", facsimile dated Nov. 7, 1996.
"Testing Program Results Validate GE's H Gas Turbine—High Efficiency, Low Cost of Electricity and Low Emissions", Roger Schonewald and Patrick Marolda, (no date available).
"Testing Program Results Validate GE's H Gas Turbine—High Efficiency, Low Cost of Electricity and Low Emissions", Slide Presentation—working draft, (no date available).
"The Next Step in H. . . For Low Cost Per kW–Hour Power Generation", LP–1 PGE '98.
"Utility Advanced Turbine System (ATS) Technology Readiness Testing and Pre–Commercialization Demonstration", Document #486040, Oct. 1—Dec. 31, 1996, Publication Date, Jun. 1, 1997, Report Nos.: DOE/MC/31176—5628.
"Utility Advanced Turbine System (ATS) Technology Readiness Testing—Phase 3", Document #666274, Oct. 1, 1996–Sep. 30, 1997, Publication Date, Dec. 31, 1997, Report Nos.: DOE/MC/31176—10.
"Utility Advanced Turbine System (ATS) Technology Readiness Testing and Pre–Commercial Demonstration, Phase 3", Document #486029, Oct. 1—Dec. 31, 1995, Publication Date, May 1, 1997, Report Nos.: DOE/MC/31176—5340.
"Utility Advanced Turbine System (ATS) Technology Readiness Testing and Pre–Commercial Demonstration—Phase 3", Document #486132, Apr. 1—Jun. 30, 1976, Publication Date, Dec. 31, 1996, Report Nos.: DOE/MC/31176—5660.
"Utility Advanced Turbine System (ATS) Technology Readiness Testing and Pre–Commercial Demonstration—Phase 3", Document #587906, Jul. 1—Sep. 30, 1995, Publication Date, Dec. 31, 1995, Report Nos.: DOE/MC/31176—5339.
"Utility Advanced Turbine System (ATS) Technology Readiness Testing and Pre–Commercial Demonstration" Document #666277, Apr. 1–Jun. 30, 1997, Publication Date, Dec. 31, 1997, Report Nos.: DOE/MC/31176—8.
"Utility Advanced Turbine System (ATS) Technology Readiness Testing and Pre–Commercialization Demonstration" Jan. 1—Mar. 31, 1996, DOE/MC/31176—5338.
"Utility Advanced Turbine System (ATS) Technology Readiness Testing: Phase 3R", Document #756552, Apr. 1—Jun. 30, 1999, Publication Date, Sep. 1, 1999, Report Nos.: DE—FC21–95MC31176–23.
"Utility Advanced Turbine System (ATS) Technology Readiness Testing.", Document #656823, Jan. 1—Mar. 31, 1998, Publication Date, Aug. 1, 1998, Report Nos.: DOE/MC/31176–17.
"Utility Advanced Turbine Systems (ATS) Technology Readiness Testing and Pre–Commercial Demonstration", Annual Technical Progress Report, Reporting Period: Jul. 1, 1995—Sep. 30, 1996.
"Utility Advanced Turbine Systems (ATS) Technology Readiness Testing", Phase 3R, Annual Technical Progress Report, Reporting Period: Oct. 1, 1997—Sep. 30, 1998.
"Utility Advanced Turbine Systems (ATS) Technology Readiness Testing", Documents #750405, Oct. 1—Dec. 30, 1998, Publication Date: May, 1, 1999, Report Nos.: DE–FC21–95MC31176–20.
"Utility Advanced Turbine Systems (ATS) Technology Readiness Testing", Document #1348, Apr. 1—Jun. 29, 1998, Publication Date Oct. 29, 1998, Report Nos. DE–FC21–95MC31176—18.
"Utility Advanced Turbine Systems (ATS) Technology Readiness Testing—Phase 3", Annual Technical Progress Report, Reporting Period: Oct. 1, 1996—Sep. 30, 1997.
"Utility Advanced Turbine Systems (ATS) Technology Readiness Testing and Pre–Commercial Demonstration", Quarterly Report, Jan.1—Mar. 31, 1997, Document #666275, Report Nos.: DOE/MC/31176–07.
"Proceedings of the 1997 Advanced Turbine Systems", Annual Program Review Meeting, Oct. 28–29, 1997.

* cited by examiner

COOLING CIRCUIT FOR A GAS TURBINE BUCKET AND TIP SHROUD

This invention was made with Government support under Contract No. DEFC21-95MC31176 awarded by the Department of Energy. The Government has certain rights in this invention.

TECHNICAL FIELD

This invention relates to a cooling circuit for a gas turbine bucket and tip shroud, using air from the gas turbine compressor.

BACKGROUND OF THE INVENTION

Gas turbine bucket tip shrouds are subject to creep damage due to the combination of high temperature and centrifugally induced bending stresses. In U.S. Pat. No. 5,482,435, there is described a concept for cooling the shroud of a gas turbine bucket, but the cooling design relies on air dedicated to cooling the shroud. Other cooling arrangements for bucket airfoils or fixed nozzle vanes are disclosed in U.S. Pat. Nos. 5,480,281; 5,391,052 and 5,350,277.

BRIEF SUMMARY OF THE INVENTION

This invention utilizes spent cooling air exhausted from the airfoil itself for cooling the associated tip shroud of the bucket. Specifically, the invention seeks to reduce the likelihood of gas turbine tip shroud creep damage while minimizing the cooling flow required for the bucket airfoil and shroud. Thus, the invention proposes the use of air already used for cooling the bucket airfoil, but still at a lower temperature than the gas in the turbine flowpath, for cooing the tip shroud. This more efficient use of cooling air has the dual advantage of tip shroud cooling with minimal degradation of performance.

In one exemplary embodiment of the invention, leading and trailing groups of cooling passages extend radially within the blade or airfoil. Each group of holes communicates with a common chamber or plenum in the tip shroud. Spent cooling air from the radial cooling passages thus flows into the tip shroud plenum, and then exits through passages from the plenum into the hot gas path. The plenum extends throughout the tip shroud, substantially from front-to-back and side-to-side, lying substantially in the plane of the shroud. The cooling air exits into the hot gas path via passages extending from the plenum to the peripheral edges of the tip shroud. Some cooling air may also be exhausted through one or more metering holes in the top surface of the tip shroud.

In a second exemplary embodiment, two discrete plenums are provided on the tip shroud, one for each of the group or set of leading cooling holes and the group or set of trailing cooling holes. A cover is provided for each plenum, extending above the tip shroud top surface. Here again, cooling air exhausts through passages extending from the plenums to the peripheral edges of the tip shroud, and, optionally, through one or more metering holes in the covers.

In its broader aspects, therefore, the invention relates to an open cooling circuit for a gas turbine airfoil and associated tip shroud including a first group of cooling holes internal to the airfoil and extending in a radially outward direction generally along a leading edge of the airfoil; a second group of cooling holes internal to the airfoil and extending in a radially outward direction generally along a trailing edge of the airfoil; a common plenum in the tip shroud in direct communication with the first and second group of cooling holes; and a plurality of exhaust holes extending from the plenum, through the tip shroud and opening along a peripheral edge of the tip shroud.

In another aspect, the invention relates to an open cooling circuit for a gas turbine airfoil and associated tip shroud comprising a first group of cooling holes internal to the airfoil and extending in a radially outward direction generally along a leading edge of the airfoil; a second group of cooling holes internal to the airfoil and extending in a radially outward direction generally along a trailing edge of the airfoil; a pair of plenums in the tip shroud, each in communication with one of the first and second groups of cooling holes; a plurality of exhaust holes extending from the pair of plenums, through the tip shroud and opening along a peripheral edge of the tip shroud.

In still another aspect, the invention relates to a method of cooling a gas turbine airfoil and associated tip shroud comprising a) providing radial holes in the airfoil and supplying cooling air to the radial holes; b) channeling the cooling air to a plenum in the tip shroud and c) passing the cooling air from the plenum and through the tip shroud.

Additional objects and advantages of the invention will become apparent from the detailed description which follows.

DETAILED DESCRIPTION OF THE INVENTION

Figure 1:
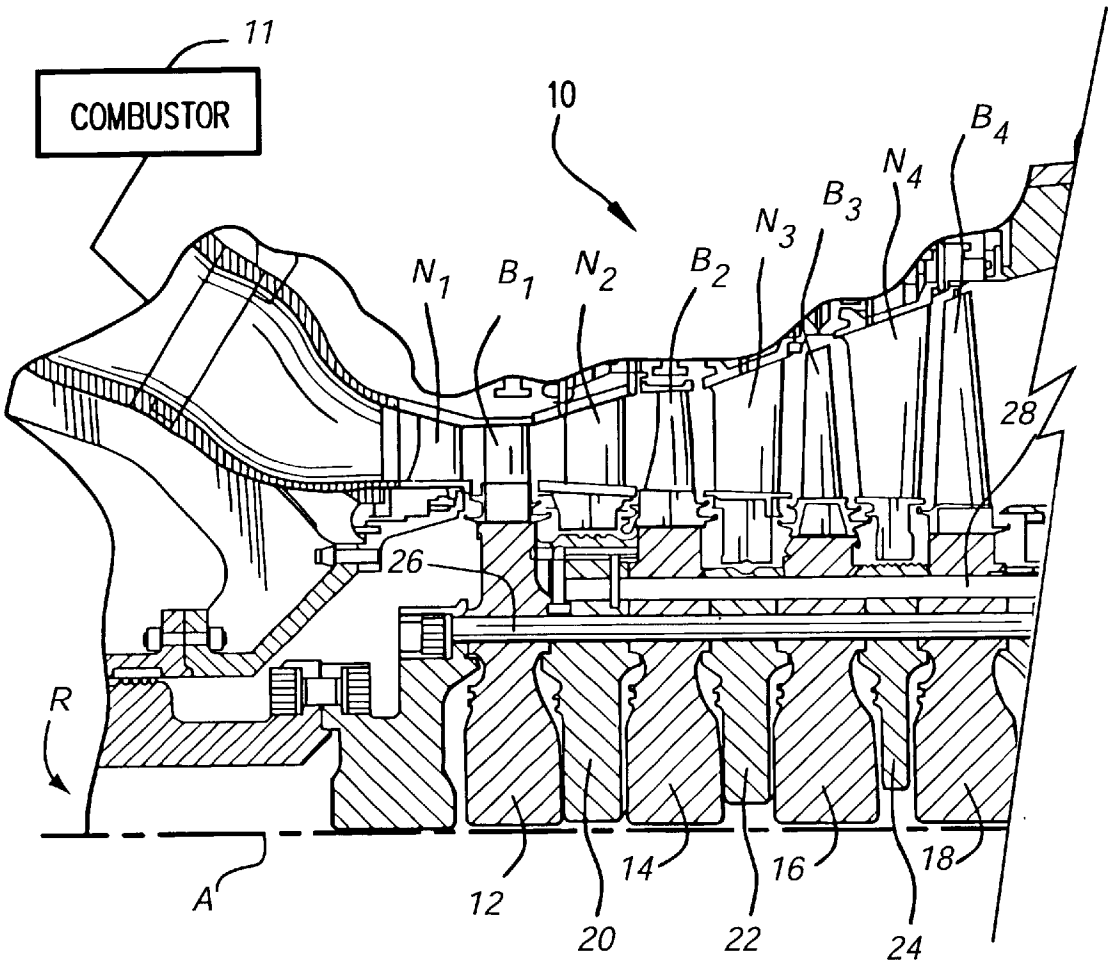
FIG. 1 is a partial side section illustrating the turbine section of a land based gas turbine.

With reference to FIG. 1, the turbine section 10 of an exemplary gas turbine is partially illustrated.

The turbine section 10 of the gas turbine is downstream of the turbine combustor 11 and includes a rotor, generally designated R, with four successive stages comprising turbine wheels 12, 14, 16 and 18 mounted to and forming part of the rotor shaft assembly for rotation therewith. Each wheel carries a row of buckets B1, B2, B3 and B4, the blades of which project radially outwardly into the hot combustion gas path of the turbine. The buckets are arranged alternately between fixed nozzles N1, N2, N3 and N4. Alternatively, between the turbine wheels from forward to aft are spacers 20, 22 and 24, each located radially inwardly of a respective nozzle. It will be appreciated that the wheels and spacers are secured to one another by a plurality of circumferentially spaced axially extending bolts 26 (one shown), as in conventional gas turbine construction.

With reference now to FIGS. 2 through 5, a turbine blade or airfoil 30 is shown with an associated radially outer tip shroud 32. The airfoil portion 30 has a first set of internal radially extending cooling holes generally designated 34 arranged along and closer to the leading edge 38 of the airfoil. At the same time, a second set of internal radially extending cooling holes generally designated 36 is arranged along and closer to the trailing edge 40 of the airfoil. Both sets of cooling holes extend radially outwardly into the tip shroud 32 and, specifically, to a common, relatively large but shallow chamber or plenum 44. The plenum 44 extends across the tip shroud substantially from front to back and side to side, within the plane of the shroud. The plenum is created in the tip shroud by a ceramic core and formed during the investment casting process. This core is held in place by one or more tabs extending out the edges of the tip shroud. Cooling air exhausts into the hot gas path through the openings 46, 48 and 50 left by these tabs when the latter are removed as part of the casting process.

Covers 52, 54 (omitted from FIG. 3 but shown in FIGS. 4 and 5) are attached to seal the plenum, and one or more metering holes 56, 58 may run from the plenum 44 through a respective cover and into the hot gas path in order to maintain proper flow. The number and diameter of the cooling air exhaust holes will depend on the design requirements and manufacturing process capability. By way of example, an additional exhaust hole is shown at 60. This arrangement provides effective film and convection cooling of the shroud, using spent cooling air from the airfoil.

Figure 2:
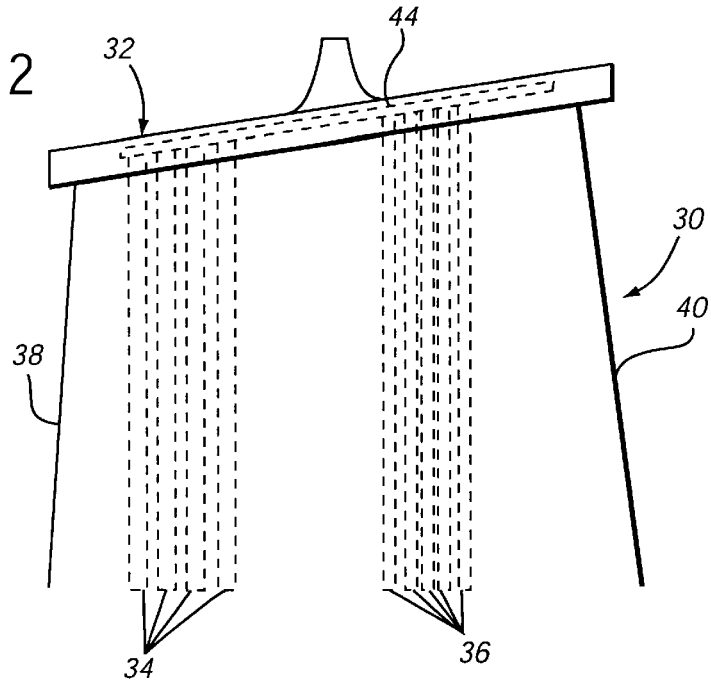
FIG. 2 is a partial side elevation, generally in schematic form, illustrating cooling passages in a turbine airfoil and tip shroud in accordance with a first exemplary embodiment of the invention.
Figure 3:
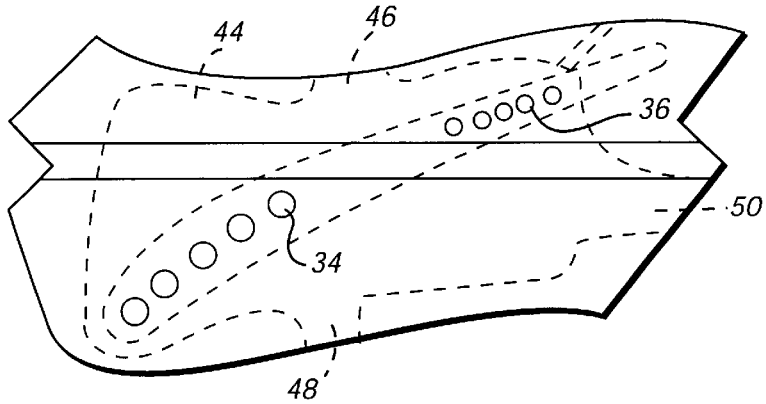
FIG. 3 is a top plan view of the tip shroud in accordance with the first embodiment but rotated 90°.
Figure 4:
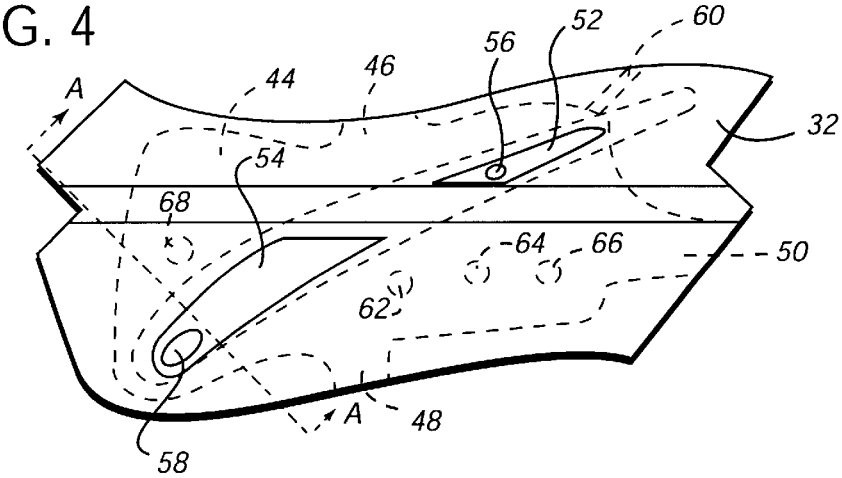
FIG. 4 is similar to FIG. 3 but with plenum covers in place.
Figure 5:
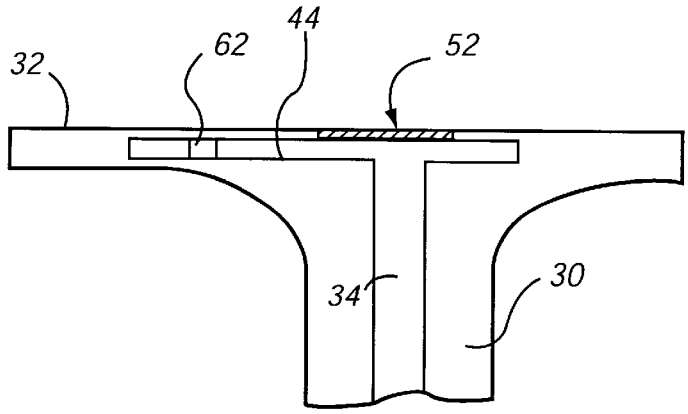
FIG. 5 is a section taken along line A—A of FIG. 4.
Figure 6:
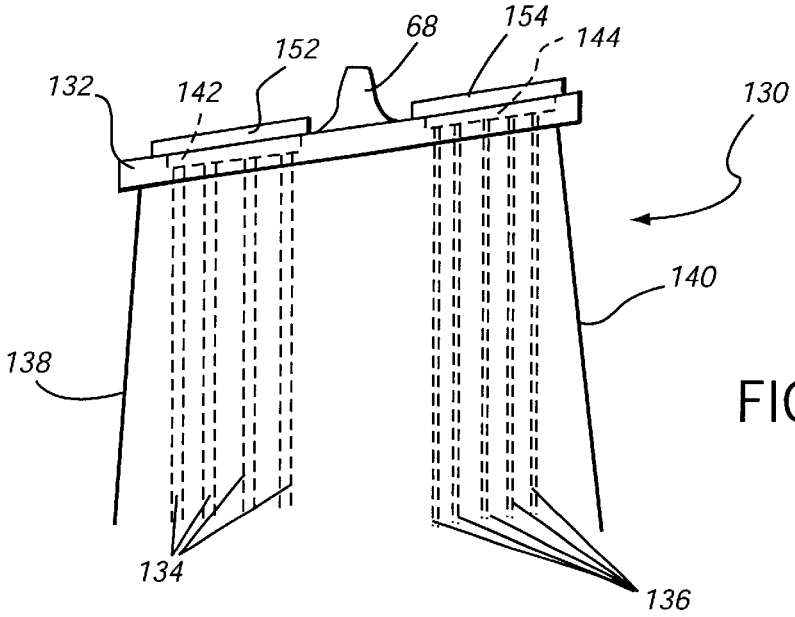
FIG. 6 is a partial side elevation, generally in schematic form, illustrating cooling passages in a turbine airfoil and tip shroud in accordance with a second exemplary embodiment of the invention.

Pin fins, or pedestals, may be required for structural integrity and/or cooling of the tip shroud, given the fairly large area of the plenum 44. Four such pin fins 62, 64, 66, 68 are shown in FIG. 4. The actual number of such pins will depend again on design requirements. Moreover, the number and diameter of the radial holes in the airfoil portion will depend, again, on design requirements and manufacturing capability. For example, FIG. 2 shows four holes in each group 34 and 36, whereas FIG. 3 shows five such holes in each group.

Turning to FIGS. 6 through 9, a second exemplary embodiment of the invention is illustrated, and for convenience, similar reference numerals have been used to designate corresponding components as used in FIGS. 2–5, but with the prefix "1" added. Thus, the turbine blade 130 has a tip shroud 132, a first set of internal cooling holes 134 extending radially outwardly through the airfoil, located closer to the leading edge 138 of the blade, and a second set of internal cooling holes 136 extend radially outwardly through the blade closer to the trailing edge 140.

Figure 7:
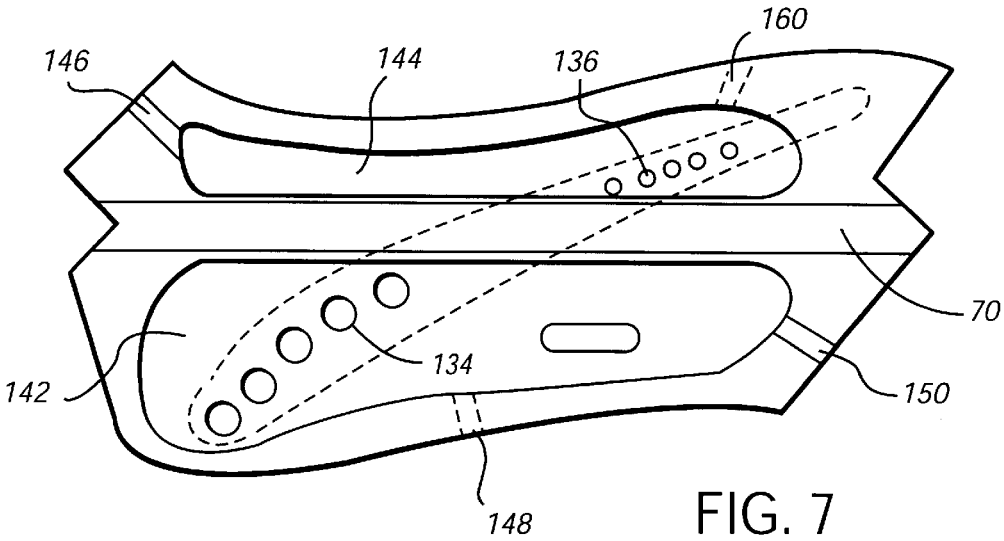
FIG. 7 is a top plan view of the tip shroud of FIG. 4, but rotated 90°.
Figure 8:
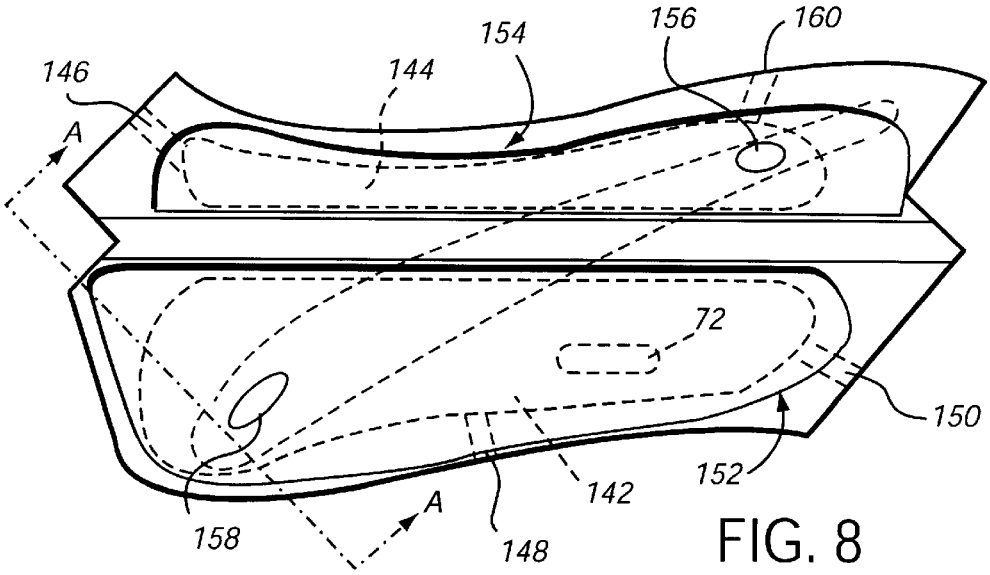
FIG. 8 is similar to FIG. 7 but with plenum covers in place.
Figure 9:
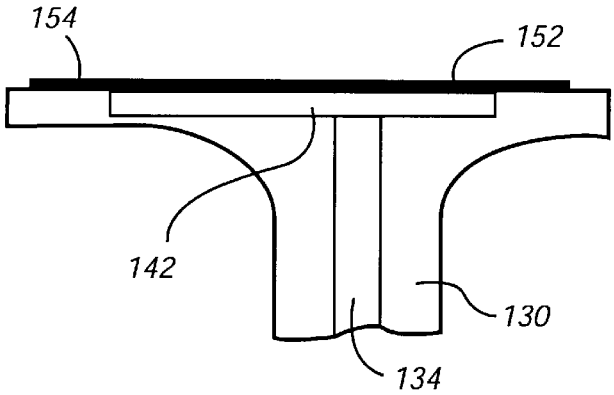
FIG. 9 is a section taken along the line A—A of FIG. 8.

In this embodiment, rather than having a single plenum formed in the tip shroud, a pair of plenums 142 and 144 are formed, one on each side of the tip shroud rail or seal 70, and spanning the leading and trailing edges of the airfoil as best seen in FIGS. 7 and 8. Here, the recesses which provide the plenums are either created in the wax pattern of the bucket and formed during the investment casting process, or machined into the finished casting. Covers 152 and 154 are attached to seal each of the respective plenums 142 and 144. In FIG. 7, the covers have been omitted for clarity, but can be seen in FIGS. 8 and 9. Cooling holes 146, 148, 150 and 160 run from the plenum, through the tip shroud into the gas path. Some cooling air will also be exhausted through metering holes 156, 158 in the tops of the covers, although, again, the number and diameter of exhaust and metering holes may be varied as necessary.

In this embodiment, an oval-shaped pad 70 is shown within the plenum 142. One or more of such pads or pedestals as described above may be required to insure proper alignment and attachment of the covers.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. An open cooling circuit for a gas turbine airfoil and substantially planar tip shroud at a radially outermost end of the airfoil and extending in a plane substantially perpendicular to the airfoil comprising:

a first group of cooling holes internal to the airfoil and extending in a radially outward direction generally along a leading edge of the airfoil;

a second group of cooling holes internal to the airfoil and extending in a radially outward direction generally along a trailing edge of the airfoil;

a common plenum in the tip shroud in direct communication with said first and second group of cooling holes, said plenum extending throughout substantially all of the tip shroud and within the plane of the tip shroud wherein said plenum is sealed by a pair of covers located over the first and second groups of cooling holes and further wherein a metering hole is provided in at least one of said covers; and a plurality of exhaust holes extending from said plenum, through said tip shroud and opening along a peripheral edge of the tip shroud.

2. The cooling circuit of claim 1 and wherein said tip shroud plenum is reinforced by one or more radially extending pedestals.

3. An open cooling circuit for a gas turbine airfoil and a substantially planar tip shroud at a radially outermost end of the airfoil and extending in a plane substantially perpendicular to the airfoil comprising:

a first group of cooling holes internal to the airfoil and extending in a radially outward direction generally along a leading edge of the airfoil;

a second group of cooling holes internal to the airfoil and extending in a radially outward direction generally along a trailing edge of the airfoil;

a pair of plenums in said tip shroud, each lying within the plane of the tip shroud in communication with one of said first and second groups of cooling holes, said pair of plenums extending substantially along and on opposite sides, respectively, of a tip shroud rail on an exterior portion of said tip shroud, and spanning the leading and trailing edges of the airfoil;

a plurality of exhaust holes extending from said pair of plenums, through said tip shroud and opening along a peripheral edge of the tip shroud.

4. The cooling circuit of claim 3 wherein each plenum is sealed by a cover projecting from a top surface of the tip shroud.

5. The cooling circuit of claim 4 wherein each cover has one or more metering holes in communication with its respective plenum.

6. A method of cooling a gas turbine airfoil having leading and trailing edges and an associated substantially planar tip shroud located at a radially outermost end of the airfoil and extending in a plane substantially perpendicular to the airfoil, the method comprising:

a) providing radial holes in said airfoil and supplying cooling air to said radial holes;

b) providing first and second plenums in said tip shroud extending throughout substantially all of said tip shroud, spanning the leading and trailing edges of the airfoil, and lying within the plane of the tip shroud;

c) channeling said cooling air to said first and second plenums in said tip shroud and d) passing said cooling air from said plenums and through said tip shroud.

7. The method of claim 6 including the step of exhausting some portion of the cooling air through the top of the tip shroud.

8. The method of claim 6 wherein step d) is carried out by providing cooling exhaust holes in said tip shroud, opening along a peripheral edge of the tip shroud.

9. The method of claim 6 wherein a first set of cooling holes closer to the reading edge of the airfoil communicates with the first plenum, and a second set of cooling holes closer to the trailing edge of said airfoil communicates with the second plenum.

* * * * *

UNITED STATES PATENT AND TRADEMARK OFFICE

CERTIFICATE OF CORRECTION

PATENT NO. : 6,761,534 B1
DATED : July 13, 2004
INVENTOR(S) : Willett

It is certified that error appears in the above-identified patent and that said Letters Patent is hereby corrected as shown below:

Column 4,
Line 5, delete "70" and insert -- 72 --

Column 6,
Line 11, delete "reading" and insert -- leading --

Signed and Sealed this

Thirtieth Day of November, 2004

JON W. DUDAS
*Director of the United States Patent and Trademark Office*